US012631095B2

(12) United States Patent
Poerschke et al.

(10) Patent No.: US 12,631,095 B2
(45) Date of Patent: May 19, 2026

(54) FULL DRIFT THROUGH A GAS LIFT INJECTION PACKER ASSEMBLY

(71) Applicant: ChampionX LLC, Sugar Land, TX (US)

(72) Inventors: Andrew Poerschke, Houston, TX (US); Paul Treavor Roberts, Longmont, CO (US)

( * ) Notice: Subject to any disclaimer, the term of this patent is extended or adjusted under 35 U.S.C. 154(b) by 0 days.

(21) Appl. No.: 19/050,304

(22) Filed: Feb. 11, 2025

(65) Prior Publication Data

US 2025/0257636 A1 Aug. 14, 2025

Related U.S. Application Data

(60) Provisional application No. 63/552,626, filed on Feb. 12, 2024.

(51) Int. Cl.
*E21B 43/12* (2006.01)
*E21B 33/12* (2006.01)
*E21B 34/02* (2006.01)

(52) U.S. Cl.
CPC ..... *E21B 43/122* (2013.01); *E21B 33/12* (2013.01); *E21B 34/02* (2013.01)

(58) Field of Classification Search
CPC ..... E21B 43/122; E21B 33/12; E21B 34/02
See application file for complete search history.

(56) References Cited

U.S. PATENT DOCUMENTS 1,779,727 A 10/1930 Boynton
2,612,117 A 9/1952 Arnall
2,944,604 A 7/1960 Baker
4,917,187 A 4/1990 Burns et al.
5,022,427 A * 6/1991 Churchman ..... E21B 43/123 137/155
5,067,568 A 11/1991 Yates, Jr. et al.
6,082,452 A 7/2000 Shaw et al.
7,681,651 B2 3/2010 Loughlin
10,612,341 B2 4/2020 Williams et al.
10,989,012 B2 4/2021 Hrabovsky
2009/0145595 A1* 6/2009 Mazzanti ..... E21B 43/122 166/106
2020/0399975 A1* 12/2020 Hrabovsky ..... E21B 33/12
2022/0389786 A1 12/2022 Main et al.

OTHER PUBLICATIONS

International Search Report and Written Opinion issued for PCT/US2025/015346 dated Apr. 2, 2025; 14 pgs.

* cited by examiner

*Primary Examiner* — Crystal J Lee
(74) *Attorney, Agent, or Firm* — Scheef & Stone, L.L.P.; Keith C. Rawlins, Esq.

(57) ABSTRACT

A gas lift injection packer assembly, a gas lift injection system that includes the assembly, and methods utilizing the assembly and system. The gas lift injection packer assembly includes a top sub, a packer coupled to the top sub, a bottom sub coupled to the packer, a sleeve disposed within the top sub, the packer, and the bottom sub. The inner diameters of the components of the gas lift injection packer assembly form a continuous passage from end-to-end of the gas lift injection packer assembly such that a downhole tool can be moved through the gas lift injection packer assembly while the gas lift injection packer assembly is sealed in a wellbore. A gas inlet port of the top sub can be formed such that an inner wall of the gas inlet port is the housing for a check valve.

18 Claims, 8 Drawing Sheets

FULL DRIFT THROUGH A GAS LIFT INJECTION PACKER ASSEMBLY

CROSS-REFERENCE TO RELATED APPLICATIONS

This application is a non-provisional patent application claiming the benefit of, and priority to, U.S. Provisional Patent Application No. 63/552,626, filed Feb. 12, 2024, which is incorporated by reference herein in its entirety.

FIELD OF THE DISCLOSURE

The present disclosure generally relates to gas lift injection, and more particularly to a gas lift injection packer assembly used for gas lift injection.

BACKGROUND

Wellbores are drilled into a subterranean formation to produce hydrocarbon fluids from a producing portion of the subterranean formation. Most wellbores will initially produce hydrocarbon fluids due to the pressure in the producing portion of the subterranean formation. When hydrocarbon fluid production ceases or slows, artificial lift systems may be used to pressurize the wellbore to aid or force hydrocarbon fluids from the producing portion of the subterranean formation, through the production string, and to a wellhead located above the surface.

Gas lift injections systems, a type of artificial lift system, are used in this context. In a gas lift injection system, a gas is injected into producing portions of the wellbore through segregated portions of the production string. The injected gas mixes with the hydrocarbon fluids, thereby creating a mixture of fluids with a lower density than the density of the hydrocarbon fluids alone. This density reduction effectively reduces a bottomhole pressure (BHP) at a lower end of the tubing, causing the flow of hydrocarbon fluids to increase and/or resume upwards through the production string and to the wellhead.

Traditional gas lift injection systems often employ a packer assembly to be installed about the production string, which enables an operator to effectively control operation and production of the wellbore. The packer assembly is used to isolate an upper portion of the wellbore from a lower portion of the wellbore disposed below the packer system to protect the upper portion from the corrosive hydrocarbon fluids and force the produced fluids into the production tubing.

To deliver the injected gas into the lower portion of the wellbore, traditional gas lift injection systems employ a bypass fluid path through the packer assembly, which commonly requires reduced diameter tubing through the packer system as compared to the diameter of the production tubing attached thereto. Due to the technical limitations on how deep the packer assembly can be set into the wellbore, there are limitations on the equipment that can be deployed downhole, which limits production. The hydrocarbon production industry continues to demand improvement in packer assembly technology that increases the capabilities of downhole production.

SUMMARY

A gas lift injection packer assembly can include a top sub; a packer coupled to the top sub; a bottom sub coupled to the packer; and a sleeve disposed within the top sub, the packer, and the bottom sub, wherein the sleeve forms a micro annulus in the packer assembly with the top sub and the packer, wherein the sleeve has full drift through the gas lift injection packer assembly. In some aspects, the sleeve can have an inner diameter that is the same as, substantially the same as, or not greater than 5% different than an inner diameter of a production tubing coupled to the top sub, to the bottom sub, or to the top sub and to the bottom sub.

Another gas lift injection packer assembly can include a top sub having a gas inlet port formed therein; a check valve disposed in the gas inlet port, wherein an inner wall of the gas inlet port is a housing for the check valve; a packer coupled to the top sub; a bottom sub coupled to the packer; a sleeve disposed within the top sub, the packer, and the bottom sub, wherein the sleeve forms a micro annulus with the top sub and the packer, wherein the gas inlet port and the check valve are in fluid communication with the micro annulus.

A gas lift injection system can include a first production tubing; a gas lift injection packer assembly including a top sub, a packer coupled to the top sub, a bottom sub coupled to the packer, and a sleeve disposed within the top sub, the packer, and the bottom sub; a second production tubing; wherein the top sub is coupled to the first production tubing, wherein the bottom sub is coupled to the second production tubing, and wherein the sleeve includes an inner diameter that is the same as, substantially the same as, or not greater than 5% different than an inner diameter of the first production tubing, an inner diameter of the second production tubing, or the inner diameter of the first production tubing and the inner diameter of the second production tubing.

Another gas lift injection system can include a first production tubing; a gas lift injection packer assembly including a top sub having a gas inlet port formed therein; a check valve disposed in the gas inlet port, wherein an inner wall of the gas inlet port is a housing for the check valve; a packer coupled to the top sub; a bottom sub coupled to the packer; a sleeve disposed within the top sub, the packer, and the bottom sub, wherein the sleeve forms a micro annulus with the top sub and the packer, wherein the gas inlet port and the check valve are in fluid communication with the micro annulus; a second production tubing; wherein the top sub is coupled to the first production tubing, wherein the bottom sub is coupled to the second production tubing.

A method of gas lift injection can include one or more of providing a production string including production tubing and a gas lift injection packer assembly coupled to the production tubing, wherein the gas lift injection packer assembly includes a top sub, a packer coupled to the top sub, a bottom sub coupled to the packer, and a sleeve disposed within the top sub, the packer, and the bottom sub, wherein the sleeve forms a micro annulus with the top sub and the packer; flowing the pressurized gas from the annulus of the wellbore through the micro annulus; flowing the pressurized gas from the micro annulus through a gas outlet port formed in the bottom sub into a lower portion of the annulus of the wellbore; and flowing the pressurized gas through one or more gas injection valves disposed in a lower portion of the production tubing. The method can utilize an embodiment of the gas lift injection packer assembly herein.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
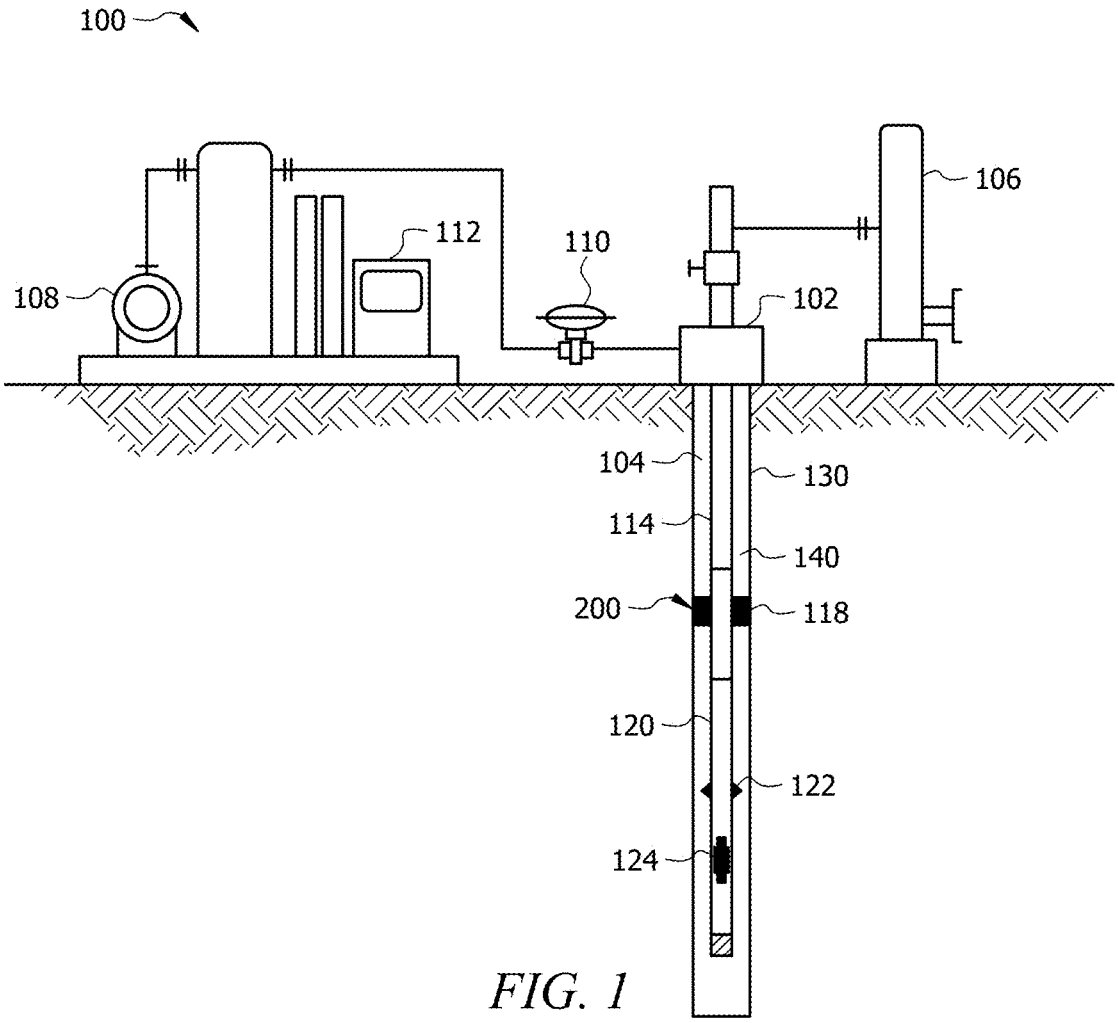
FIG. 1 illustrates a schematic diagram of a gas lift injection system according to an embodiment of the disclosure.

Referring to FIG. 1, a schematic diagram of a gas lift injection system 100 is shown according to an embodiment of the disclosure. The gas lift injection system 100 may generally be configured for producing hydrocarbon fluids from a wellbore 130 that extends into a subterranean formation. More specifically, the gas lift injection system 100 may comprise a form of artificial lift system that may be used to selectively inject pressurized gas into the wellbore 130 to increase the production of the hydrocarbon fluids from the subterranean formation.

The gas lift injection system 100 may generally comprise a wellhead 102, a production string 104 extending from the wellhead 102 into the wellbore 130, a separator 106 connected to the wellhead 102, a gas lift injection compressor 108, a gas lift injection control valve 110, and a control system 112. The wellhead 102 may generally be disposed on top of the wellbore 130, or in some aspects, on top of a casing cemented within the wellbore 130. The wellhead 102 may be coupled to the production string 104 and configured to receive produced hydrocarbon fluids therefrom. In some embodiments, the wellhead 102 may include components known in the art with the aid of this disclosure, such as a production tree, stuffing box, one or more seals, a blowout preventer (BOP), or any combination thereof.

In some aspects, the wellhead 102 may be fluidly connected to the separator 106. The wellhead may be configured to deliver fluids produced from the wellbore 130 to the separator 106. The separator 106 may separate the produced hydrocarbon fluids from the injected gas that has aided in carrying the hydrocarbon fluids to the wellhead 102. After separation, the separator 106 may subsequently distribute the separated hydrocarbon fluids to a storage vessel and/or pipeline for production.

The production string 104 may generally be connected to the wellhead 102 and extend from the wellhead 102 into the wellbore 130. The production string 104 may comprise upper production tubing 114, a gas lift injection packer assembly 200 comprising one or more packer elements or seals 118, and a lower production tubing 120. The upper production tubing 114 may be coupled to the wellhead 102, the gas lift injection packer assembly 200 may be coupled to the upper production tubing 114, and the lower production tubing 120 may be coupled to the gas lift injection packer assembly 200. Collectively, the production string 104 may extend into the wellbore 130 and comprise a fluid pathway for the produced hydrocarbon fluids to reach the wellhead 102. An annulus 140 may be present between an outer surface of the production string 104 and an inner surface of the wellbore 130 or an inner surface of a casing that can be cemented to the inner surface of the wellbore 130, through which the pressurized gas from the gas lift injection system 100 is delivered.

The packer element or seal 118 may be disposed in the annulus 140 and between a sleeve of the gas lift injection packer assembly 200 and the inner surface of the wellbore 130 or the inner surface of the casing that is cemented in the wellbore 130. The packer element or seal 118 may form a fluid tight seal that fluidly isolates an upper portion of the annulus 140 located above the packer element or seal 118 from a lower portion of the annulus 140 located below the packer element or seal 118. The seal contains hydrocarbon fluids within the lower portion of the annulus 140 and forces hydrocarbon fluids into the lower production tubing 120 of the production string 104. In some embodiments, the packer element or seal 118 may be elastomeric and may be selectively expandable to from the seal in the annulus 140.

The gas lift injection system 100 may generally comprise a gas lift injection compressor 108. The gas lift injection compressor 108 may be configured to receive an injection gas (e.g., a low pressure natural gas (or other gas) from a so-called "sales line" or from a neighboring well, nitrogen or other inert gas, carbon dioxide, air, or combinations thereof) and pressurize the injection gas for use in the gas lift injection system 100. The gas lift injection compressor 108 may be coupled to a gas lift injection control valve 110 that selectively regulates the pressure and/or flow of the pressurized gas from the gas lift injection compressor 108 into the wellbore 130, and more specifically into the upper portion of the annulus 140 formed between the production string 104 and the wellbore 130. In some embodiments, the pressurized gas may be injected into the wellbore 130 through a portion of the wellhead 102.

The gas lift injection system 100 may also comprise a control system 112 that is configured to control the mechanical equipment of the gas lift injection system 100. In some embodiments, the control system 112 may comprise one or more control interfaces. In some embodiments, the control system may be networked with sensors disposed in the gas lift injection system 100 and/or the wellbore 130 to facilitate real-time feedback and control of the gas lift injection system 100 and/or its individual components (e.g., via Wi-Fi, Bluetooth, NFC, ethernet cables, other wired connections, or combinations thereof).

During operation of the gas lift injection system 100, the control system 112 may operate to control the flow of pressurized gas from the gas lift injection compressor 108, through the gas lift injection control valve 110, and into the wellbore 130. The pressurized gas is delivered into the upper portion of the annulus 140 formed between the production string 104 and the casing of the wellbore 130. The pressurized gas may enter the gas lift injection packer assembly 200 from the annulus 140 above the packer element or seal 118, pass through the gas lift injection packer assembly 200, and exit the gas lift injection packer assembly 200 into the lower portion of the annulus 140 below the packer element or seal 118, where the pressurized gas may enter one or more gas injection valves 122 disposed in the lower production tubing 120 of the production string 104.

When injected into the lower production tubing 120 via the gas injection valves 122, the pressurized gas may mix with the hydrocarbon fluids in the lower production tubing 120 and/or the wellbore 130, thereby creating a mixture of fluids having a lower density than the density of the hydrocarbon fluids alone. This density reduction caused by the mixture of the pressurized gas with the hydrocarbon fluids effectively reduces a bottomhole pressure (BHP) at a lower end of the production string 104 and/or the wellbore 130, causing the flow of hydrocarbon fluids to increase and/or resume (in the case of a non-productive well) upwards through the production string 104 and to the wellhead 102, where the mixture can be passed through the separator 106 to separate the hydrocarbon fluids from the injected gas.

As will be discussed herein in more detail, the gas lift injection system 100 may allow gas injection to occur at a bottom of the production string 104 and/or the wellbore 130. Additionally, the gas lift injection system 100 may enable selectively deployment of downhole tools, such as plunger 124, past or through the gas lift injection packer assembly 200, thereby enabling increased drawdown of pressure within the wellbore 130, which increases production and is not readily achievable with traditional gas lift injection systems that have a reduced diameter through the packer assembly portion of a traditional production tubing.

Figure 2:
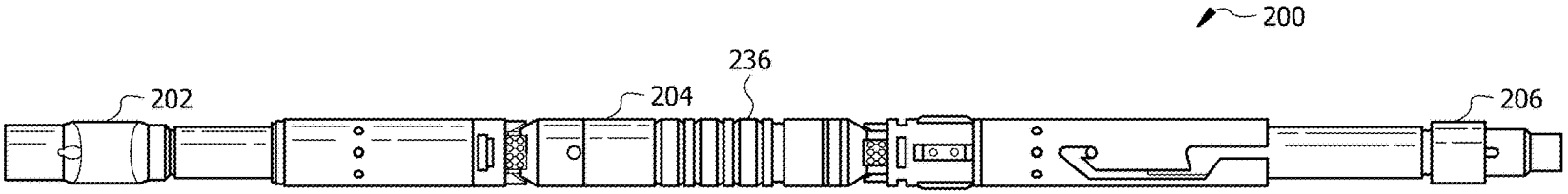
FIG. 2 illustrates an orthogonal side view of a gas lift injection packer assembly according to an embodiment of the disclosure.
Figure 3:
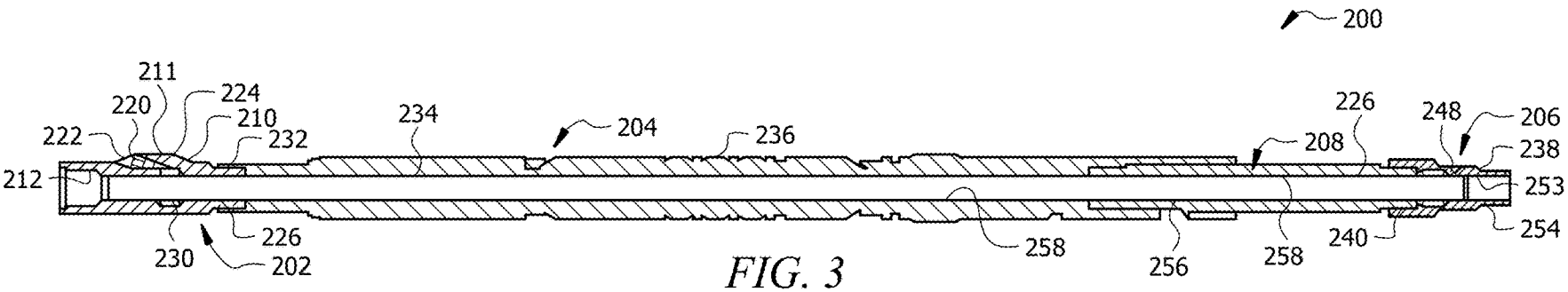
FIG. 3 illustrates a cross-sectional side view of the gas lift injection packer assembly according to an embodiment of the disclosure.
Figure 4A:
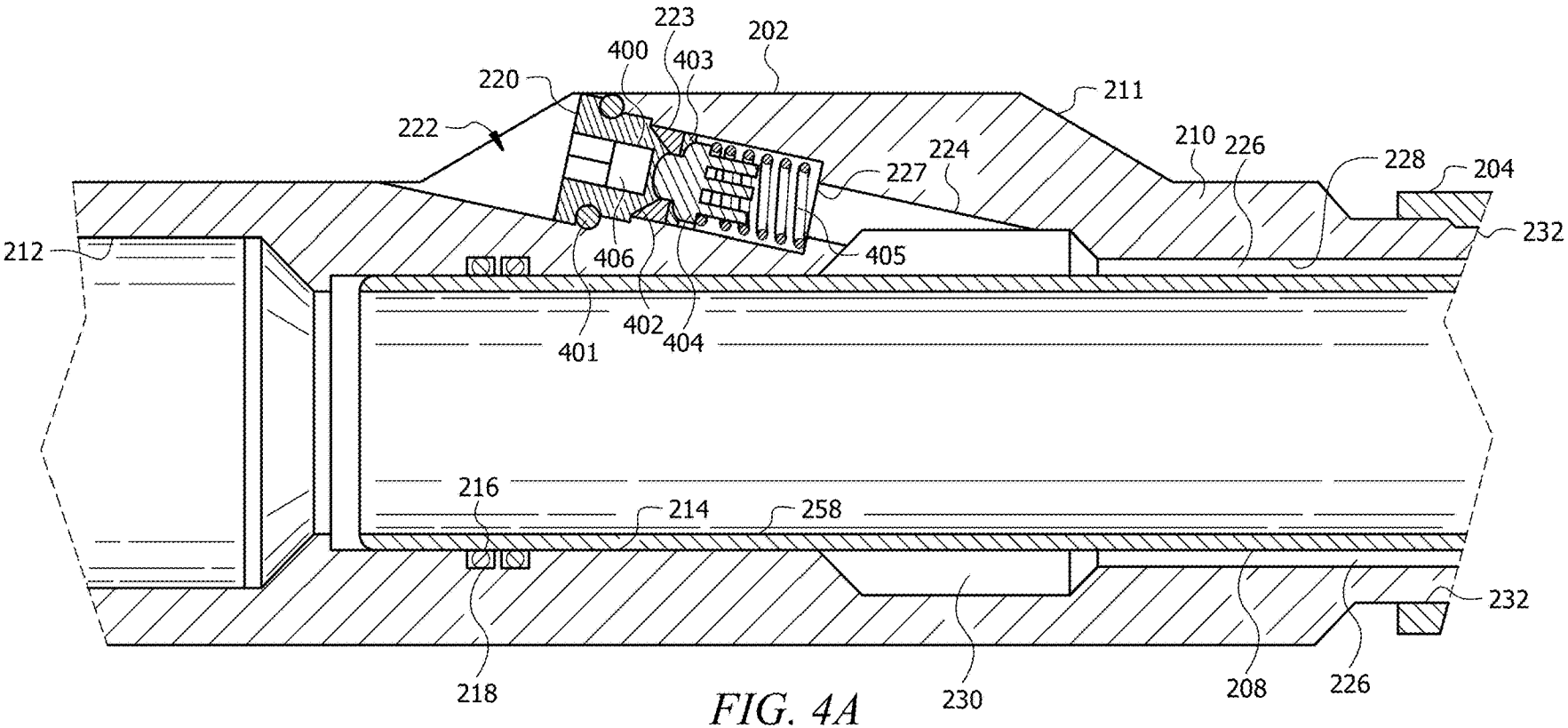
FIG. 4A illustrates a detailed cross-sectional side view of a top portion of the gas lift injection packer assembly according to an embodiment of the disclosure.
Figure 4B:
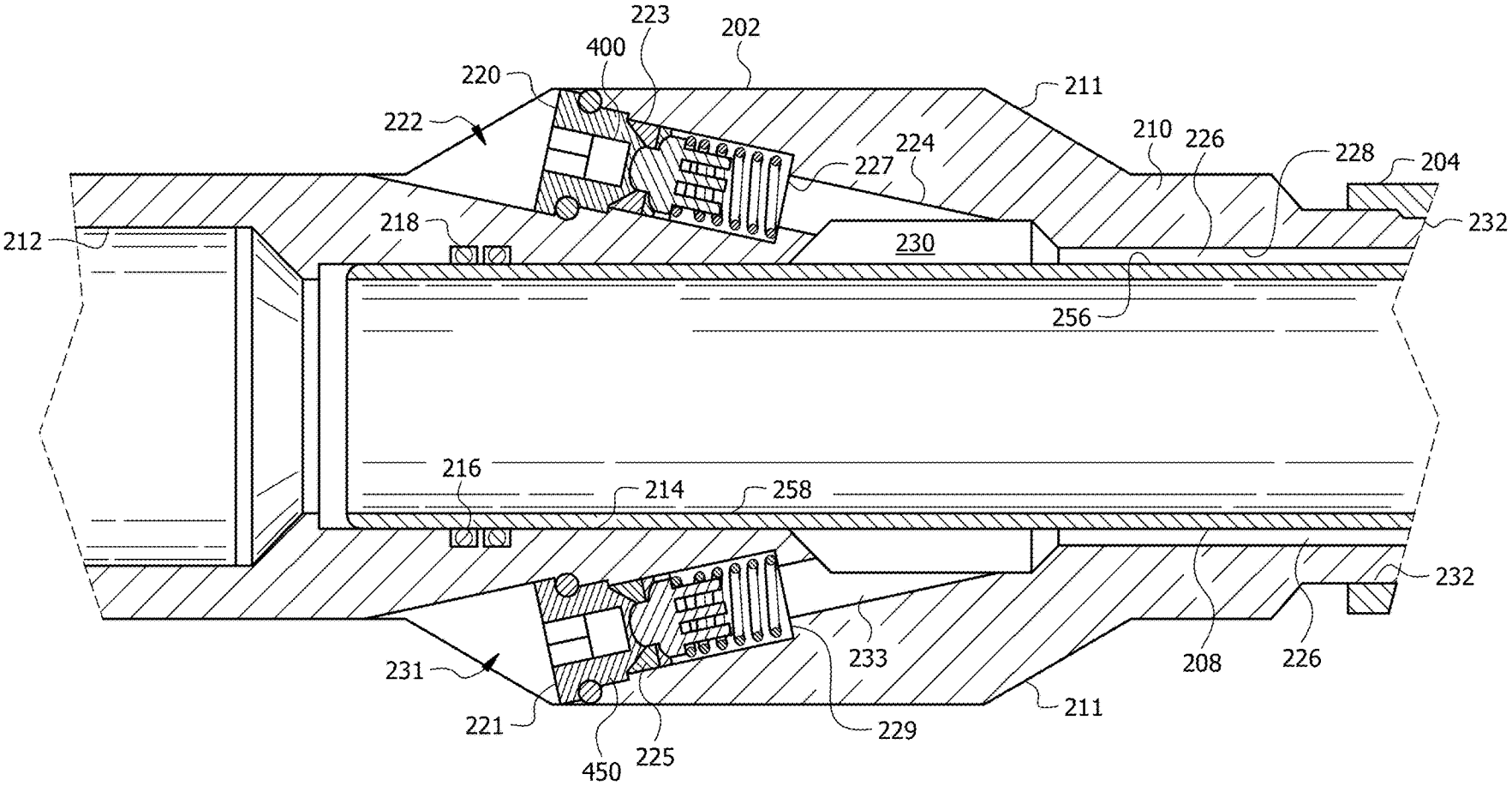
FIG. 4B illustrates a detailed cross-sectional side view of a top portion of the gas lift injection packer assembly according to another embodiment of the disclosure.
Figure 4C:
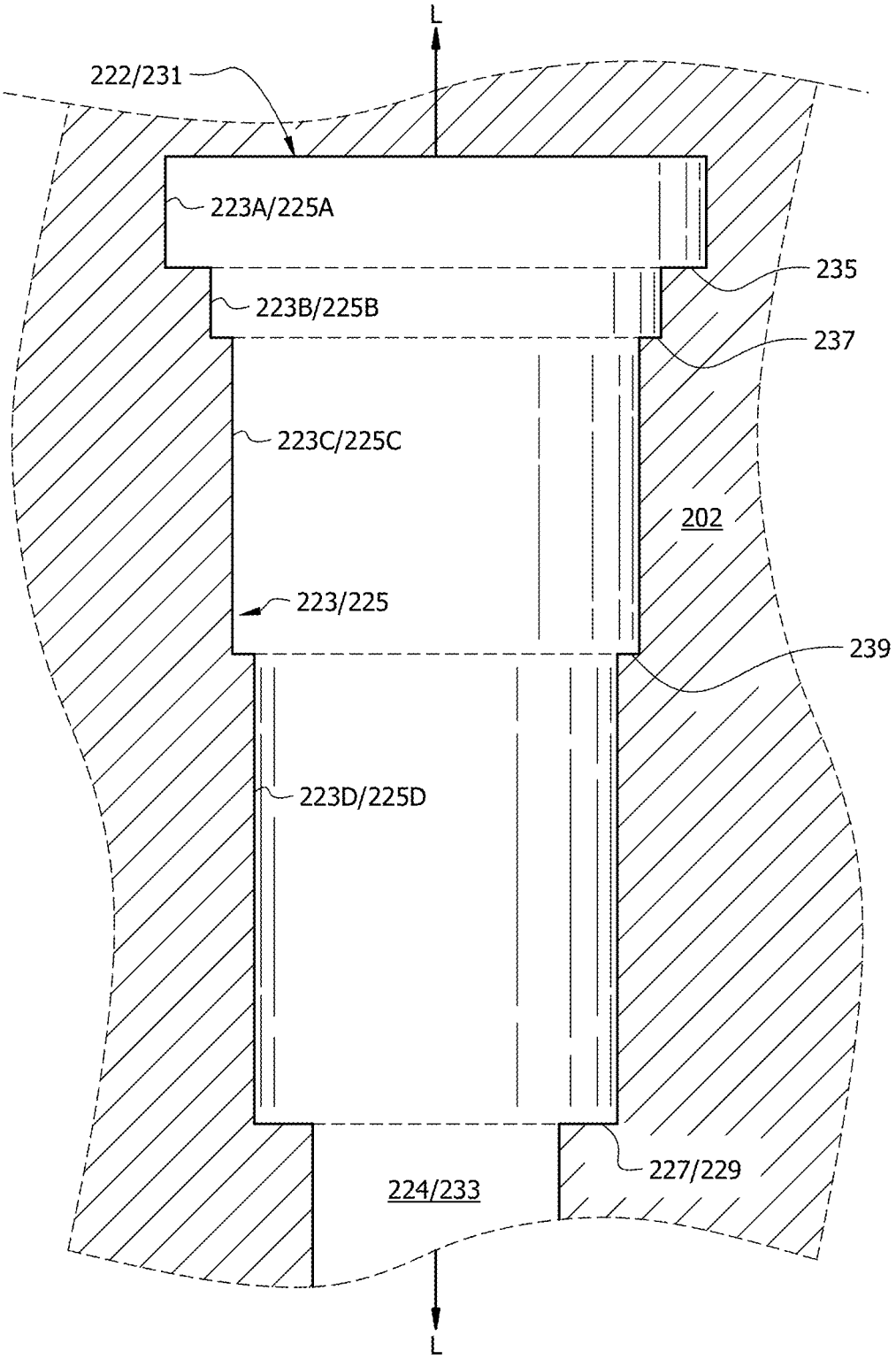
FIG. 4C illustrates an isolated cross-sectional view of a port formed in the top sub, without the check valve placed in the gas injection port.
Figure 4D:
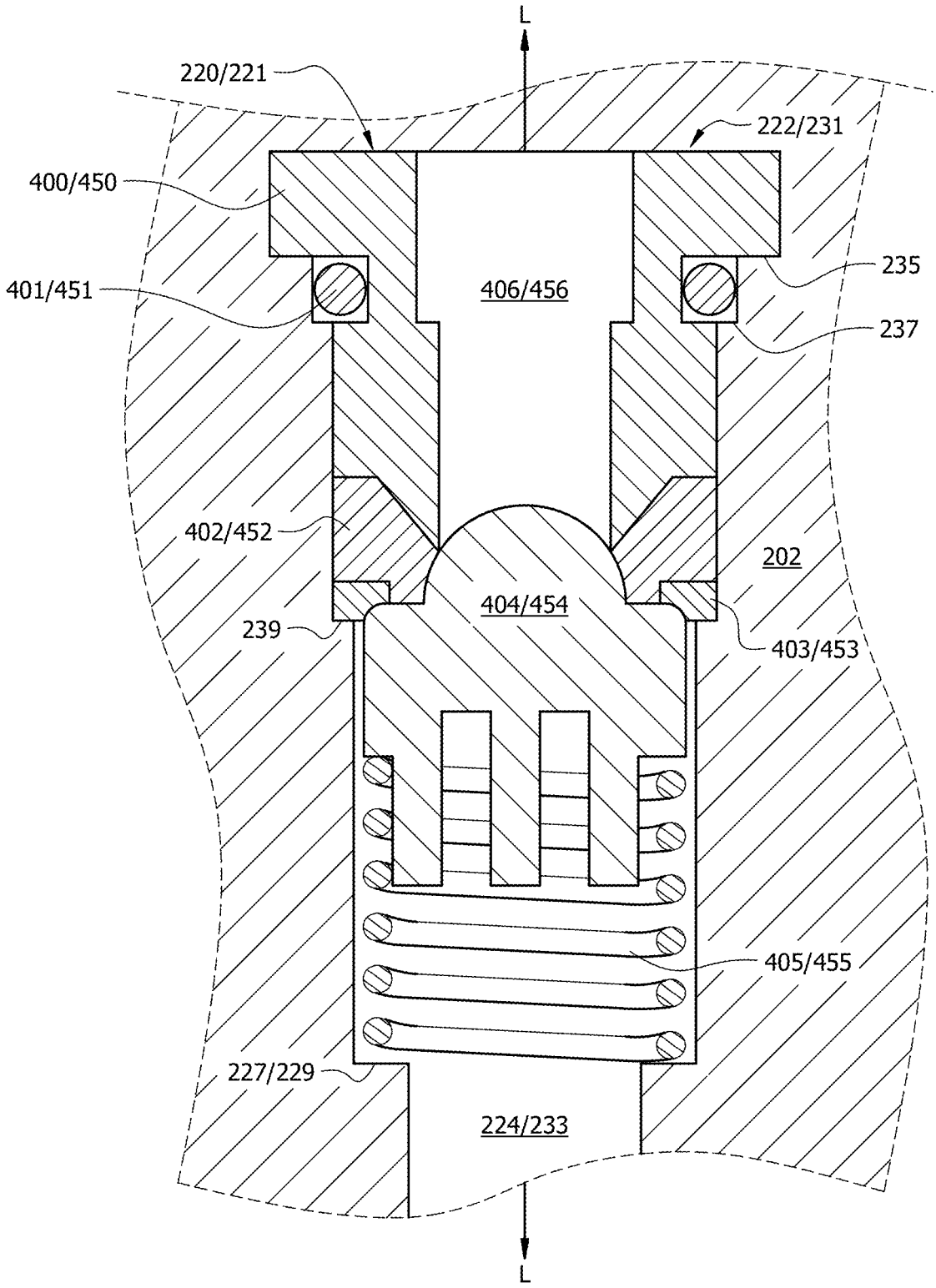
FIG. 4D illustrates an isolated cross-sectional view of a port formed in the top sub, with the check valve placed in the gas injection port.
Figure 5:
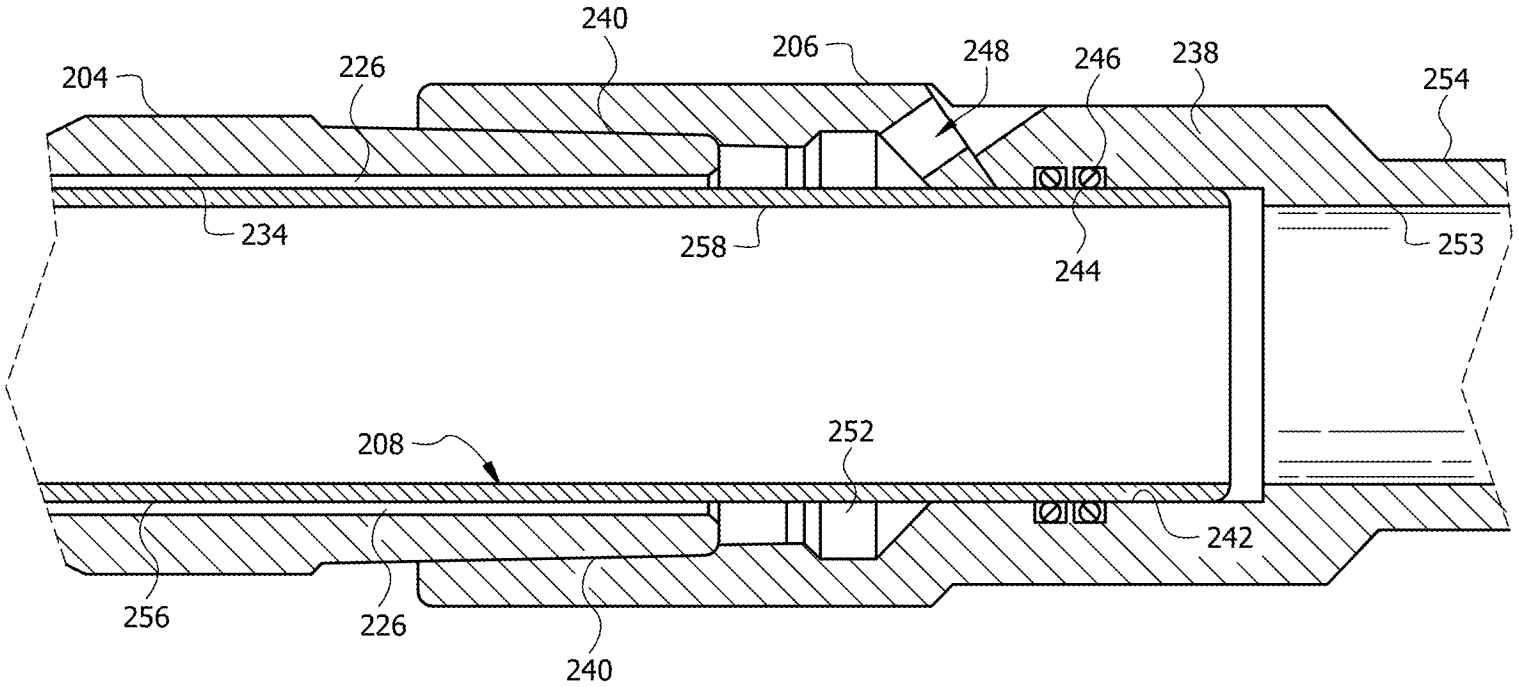
FIG. 5 illustrates a detailed cross-sectional side view of a bottom portion of the gas lift injection packer assembly according to an embodiment of the disclosure.

The following discussion shall refer to components of the gas lift injection packer assembly 200 that are illustrated in one or more of FIGS. 2, 3, 4A, 4B, 4C, 4D, and 5. FIG. 2 illustrates an orthogonal side view of a gas lift injection packer assembly 200, FIG. 3 illustrates a cross-sectional side view the gas lift injection packer assembly 200, FIG. 4A illustrates a detailed cross-sectional side view of a top portion of the gas lift injection packer assembly 200, FIG. 4B illustrates another detailed cross-sectional side view of a top portion of the gas lift injection packer assembly 200, FIG. 4C illustrates an isolated cross-sectional view of a port formed in the top sub, without a check valve placed in the gas injection port, FIG. 4D illustrates an isolated cross-sectional view of a port formed in the top sub, with the check valve placed in the gas injection port, and FIG. 5 illustrates a detailed cross-sectional side view of a bottom portion of the gas lift injection packer assembly 200 are shown according with embodiments of the disclosure.

The gas lift injection packer assembly 200 may be suitable for use in the gas lift injection system 100. The gas lift injection packer assembly 200 may comprise a top sub 202, a packer 204, a bottom sub 206, and a sleeve 208. In some aspects, the gas lift injection packer assembly 200 includes one or more check valves embedded in the top sub 202. In aspects, the inner diameters of the sleeve 208, the top sub 202, the bottom sub 206, and the production tubing form a continuous passage that enables movement of a downhole tool through the gas lift injection packer assembly 200.

The top sub 202 may comprise a main annular body 210 and may be connectable to the upper production tubing 114 (in FIG. 1) via an upper threaded connection 212 of the top sub 202. In some embodiments, the upper threaded connection 212 may comprise a 2.875" EUE (8RD) female thread configured to receive a complementary male thread of the upper production tubing 114. The body 210 may comprise a central bore 214 configured to receive the sleeve 208. In some embodiments, one or more annular seals 216 may be disposed within one or more recesses 218 formed in the central bore 214 that are configured to form an annular fluid tight seal between the top sub 202 and the sleeve 208 and/or retain or secure the sleeve 208 within the central bore 214 of the top sub 202.

The body 210 of the top sub 202 may also comprise one or more gas inlet port 222 formed in a protruding shoulder 211 of the body 210. The gas inlet port 222 in FIG. 3 is illustrated as housing a check valve 220, the arrangement which is described in more detail herein FIG. 4A illustrates one gas inlet port 222 having one check valve 220 housed therein, and FIG. 4B illustrates two gas inlet ports 222 and 231, where gas inlet port 222 has check valve 220 and gas inlet port 231 has check valve 221 housed therein.

The gas inlet port 222 is fluidly connected to an injected gas runner 224, and the injected gas runner 224 is fluidly connected to a micro annulus 226, for example, via a manifold 230. The injected gas runner 224 functions as a channel for flow of gas therethrough, that connects the gas inlet port 222 with the manifold 230. While one gas inlet port 222 is illustrated in FIG. 4A, this disclosure contemplates that multiple gas inlet ports 222 can be formed in a circumferential manner in the body 210 of the top sub 202, such as is illustrated in FIG. 4B where the protruding shoulder 211 extends around the entire circumference of the top sub 202. An inner wall 223 of the gas inlet port 222 has an inner diameter sufficient to hold a valve seat 400 of a check valve 220. The gas inlet port 222 and the check valve 220 can be in fluid communication with the micro annulus 226. The valve seat 400 can be connected to the inner wall 223 in friction fit relationship, such as via threads on an outer surface of the valve seat 400 that mate with threads on the inner wall 223. The check valve 220 can include a seal ring 401, a check seal 402, a check seal retainer 403, a dart 404, and a spring 405. The seal ring 401 is positioned between the valve seat 400 and the inner wall 223 of the gas injection port 222. The seal ring 401 creates a seal between the inner wall 223 of the gas injection port 222 and the outer surface of the valve seat 400 of the check valve 220. The check seal 402 is positioned within the gas injection port 222 to contact the bottom of the valve seat 400, the inner wall 223, the check seal retainer 403, and the dart 404. The check seal retainer 403 is positioned within the gas injection port to contact the inner wall 223 of the gas injection port 222, the bottom of the check seal 402, and a shoulder of the dart 404. The check seal retainer 403 is configured to retain the check seal 402 in position. The dart 404 is configured to move longitudinally in the gas injection port 222. A head of the dart 404 is configured to fit into the interior 406 of the valve seat 400, and when paced into contact with the valve seat 400, obstructs a flow of fluid from the runner 224 into the valve seat 400 by a seal that is created by the dart 404 against the valve seat 400, the check seal 402, the check seal retainer 403, or a combination thereof. The spring 405 contacts the dart 404 and the abutment surface 227. The spring 405 can compress in response to a pressure that pushes the dart 404 from the valve seat 400 toward the runner 224, and the spring can extend to seat the head of the dart 404 against the valve seat 400 when a pressure less than the spring force is present outside the top sub 202. Movement of the dart 404 and spring 405 open and close the check valve 220 for flow of gas, or to stop flow of gas, into the runner 224 and prevent fluid from traveling from the runner 224 and out of the top sub 202.

The check valve 220 has no separate housing as is conventionally used for check valves in gas lift injection systems. Instead, the inner wall 223 of the gas injection port 222 is the housing for the check valve 220, e.g., the inner wall 223 is the housing for the valve seat 400 and other components of the check valve 220 (e.g., the seal ring 401, the check seal 402, the check seal retainer 403, the dart 404, and the spring 405. The components of the check valve 220 can be referred to as "embedded" in the body 210 of the top sub 202 because the check valve 220 has no component that is a housing and instead the inner wall 223 of the gas injection port 222 is the housing for the check valve 220. In aspects, an inner diameter of the gas injection port 222 can be greater than an inner diameter of the runner 224 such that an abutment surface 227 is formed where the gas injection port 222 meets the runner 224. The abutment surface 227 can keep the moving components (e.g., ball and spring) of the check valve 220 in the gas injection port 222 and can keep components of the check valve 220 from moving into the runner 224.

In some embodiments, a longitudinal axis of the gas injection port 222 and the check valve 220 (see axis L-L in FIG. 4C and FIG. 4D) may be disposed at an angle of between about 10 degrees and 15 degrees with respect to a central axis (e.g., a longitudinal axis) of the gas lift injection packer assembly 200. In a particular embodiment, the gas injection port 222 and check valve 220 may be disposed at an angle of about 12 degrees with respect to a central axis of the gas lift injection packer assembly 200. The gas inlet port 222 may comprise an injected gas runner 224 in fluid connection with a micro annulus 226 formed in the body 210 between a second bore 228 of the top sub 202 and the sleeve 208. The second bore 228 may be axially aligned with the central bore 214 and comprise a diameter that is larger than the diameter of the central bore 214. The second bore 228 and the micro annulus 226 may extend from the injected gas runner 224, or a manifold 230 that annularly fluidly connects the injected gas runner 224, through a lower distal end of the top sub 202.

FIG. 4B illustrates that, in some embodiments, the protruding shoulder 211 of the body 210 of the top sub 202 can extend around the entire circumference of the body 210 of the top sub 202 to accommodate formation of multiple gas inlet ports. The protruding shoulder 211 in such embodiments may comprise one or a plurality of gas inlet ports (e.g., two gas inlet ports 222 and 231 being illustrated in FIG. 4B) formed therein, wherein a check valve is placed in each port (e.g., check valve 220 is placed in port 222 and check valve 221 is placed in port 231). The check valve 220 and port 222 have the same components and configuration as described for FIG. 4A. The check valve 221 and port 231 have the same configuration and components as the check valve 220 and port 222.

The check valve 220 is embedded as described above for FIG. 4A. Likewise, the check valve 221 has no separate housing as is conventionally used for check valves gas lift injection systems. Instead, the inner wall 225 of the gas injection port 231 is the housing for the check valve 221, e.g., the inner wall 225 is the housing for the valve seat 450 and other components of the check valve 221. The components of the check valve 221 can be referred to as "embedded" in the body 210 of the top sub 202 because the check valve 221 has no component that is a housing and instead the inner wall 223 of the gas injection port 222 is the housing for the check valve 220.

FIG. 4C illustrates an isolated cross-sectional view of a gas inlet port formed in the top sub 202, without a check valve placed in the gas injection port. The gas inlet port illustrated is applicable for port 222 and port 231, and will be referred to as ports 222/231. The remainder of the discussion for FIG. 4C shall use reference numerals that refer to both ports 222/231. The inner wall 223/225 of the gas injection ports 222/231 has first section 223A/225A, second section 223B/225B, third section 223C/225C, and fourth section 223D/225D. A diameter of the first section 223A/225A is greater than a diameter of the second section 223B/225B such that abutment surface 235 is formed. A diameter of the second section 223B/225B is greater than a diameter of the third section 223C/225C such that abutment surface 237 is formed. A diameter of the third section 223C/225C is greater than a diameter of the fourth section 223D/225D such that abutment surface 239 is formed. The abutment surfaces 235, 237, 239, 227/299 are configured to contact and hold various components of the check valves 220 and 221 as described in FIG. 4D.

FIG. 4D illustrates an isolated cross-sectional view of the gas injection port of FIG. 4C, with the check valve 220/21 placed in the gas injection port 222/231. Check valve 220 can have the valve seat 400, the seal ring 401, the check seal 402, the check seal retainer 403, the dart 404, and the spring 405. The check valve 221 can have the valve seat 450, the seal ring 451, the check seal 452, the check seal retainer 453, the dart 454, and the spring 455. The abutment surface 235 can contact a bottom side of a top portion of the valve seat 400/450. The abutment surface 237 can contact the seal ring 401/451. The abutment surface 239 can contact the check seal retainer 403/453. The abutment surface 227/229 can contact the spring 405/455. The check valve 220/221 is in the closed position, in that the head of the dart 404/454 can be seen obstructing a flow of fluid in the direction from the runner 224/233 into the interior 406/456 of the valve seat 400/450. The dart 404/454 and spring 405/455 move in the direction of the longitudinal axis L-L. In the open position, the head of the dart 404/454 moves downwardly (with reference to direction in the view, not necessarily to direction in position in a wellbore) such that the head of the dart 404/454 does not obstruct a flow of gas that flows through the interior 404/456 of the valve seat 400/450 and into the runner 224/233 Legs of the dart 404/454 can be seen in operable connection with the spring 405/455.

Returning to FIG. 2, the packer 204 may generally be connectable to the top sub 202 via a threaded connection 232. In some embodiments, the threaded connection 232 may comprise a 2.875" EUE (8RD) thread. In some embodiments, the top sub 202 may comprise the male thread, and the packer 204 may comprise the female thread, such that the top sub 202 is threaded into the packer 204 to form a fluid tight seal between the top sub 202 and the packer 204. In some embodiments, the packer 204 may be formed from multiple components that are coupled to form a fluid tight seal therebetween. However, in some embodiments, the packer 204 may be formed from a unitary component.

The packer 204 may comprise a central bore 234. The central bore 234 may extend through the entire length of the packer 204. The central bore 234 may form the micro annulus 226 through the packer 204 between the central bore 234 and the sleeve 208. In some embodiments, the central bore 234 may comprise the same or substantially similar diameter as the second bore 228 through the top sub 202, such that the micro annulus 226 maintains a constant and continuous diameter through each of the top sub 202 and the packer 204.

The packer 204 may also comprise one or more packer elements or seals 236. The packer elements or seals 236 may form a fluid tight seal between the upper portion of the annulus 140 located above the packer elements or seals 236 and a lower portion of the annulus 140 located below the packer elements or seals 236 to contain hydrocarbon fluids within the lower portion of the annulus 140 and force hydrocarbon fluids into the production string 104. In some embodiments, the packer elements or seals 236 may be elastomeric and may be selectively expandable to seal the annulus 140.

As illustrated in FIG. 5, the bottom sub 206 may comprise a main annular body 238 and may be connectable to the packer 204 via an upper threaded connection 240. In some embodiments, the threaded connection 240 may comprise a 2.875" EUE (8RD) thread. In some embodiments, the packer 204 may comprise the male thread, and the bottom sub 206 may comprise the female thread, such that the packer 204 is threaded into the bottom sub 206 to form a fluid tight seal between the packer 204 and the bottom sub 206.

The body 238 of the bottom sub 206 may comprise a central bore 242 configured to receive the sleeve 208. In some embodiments, one or more annular seals 244 may be disposed within one or more recesses 246 formed in the central bore 242 that are configured to form an annular fluid tight seal between the bottom sub 206 and the sleeve 208 and/or retain or secure the sleeve 208 within the central bore 242 of the bottom sub 206.

The body 238 of the bottom sub 206 may also comprise one or more gas outlet port 248. The gas outlet port 248 may be annularly disposed about the body 238 of the bottom sub 206. The gas outlet port 248 may be in fluid connection (e.g., via a manifold 252) with the micro annulus 226 formed between the packer 204 and the sleeve 208 to allow the pressurized gas that enters the gas lift injection packer assembly 200 from the upper portion of the annulus 140 of the wellbore 130 to exit the gas lift injection packer assembly 200 and enter the lower portion of the annulus 140 of the wellbore 130. In aspects, the manifold 252 has an inner diameter that is greater than an inner diameter of the central bore 242.

The bottom sub 206 may also comprise a second bore 253 that extends from the central bore 242 of the bottom sub 206 to a distal end of the bottom sub 206. The second bore 253 may be axially aligned with the central bore 242 and comprise a diameter that is smaller than the diameter of the central bore 242. In some embodiments, the second bore 253 may comprise a diameter that is the same or substantially similar as the inner diameter of the upper production tubing 114 and/or an inner diameter of the inner surface 258 of the sleeve 208. Additionally, the bottom sub 206 may also be connectable to the lower production tubing 120 via a lower threaded connection 254.

The sleeve 208 may be disposed within each of the top sub 202, the packer 204, and the bottom sub 206. In aspects, the sleeve 208 is a floating tube, in that, the sleeve is held in place by the top sub 202, the packer 204, and the bottom sub 206; and may contact one or more of the top sub 202, and the bottom sub 206; but is not connected to the top sub 202, the packer 204, or the bottom sub 206. The sleeve 208 may float within the top sub 202, the packer 204, and the bottom sub 206 via seals 216 and seals 244. In some embodiments, the sleeve 208 may comprise a unitary component in the shape of a tube. In other embodiments, the sleeve 208 may be formed from a series connectable components, such a series of tube segments connected end to end to one another to form the sleeve 208. The sleeve 208 may generally comprise an outer surface 256 having an outer diameter and an inner surface 258 having an inner diameter. The sleeve 208 also comprises a length that may be determined by the size of the top sub 202, the packer 204, the bottom sub 206, a curvature of the wellbore 130, or a combination thereof.

The sleeve 208 may be sized to facilitate hydrocarbon fluid production through the gas lift injection packer assembly 200. In some embodiments, the central bore 214 of the top sub 202 and the central bore 242 of the bottom sub 206 may be sized to accommodate the sleeve 208. In some embodiments, the central bore 214 of the top sub 202 and the central bore 242 of the bottom sub 206 may be about 2.165+/−0.010 inches, and the outer diameter of the outer surface 256 of the sleeve 208 may be about 2.15 inches. In some embodiments, the second bore 228 of the top sub 202 and the central bore 234 of the packer 204 may be sized to form the micro annulus 226 with the outer surface 256 of the sleeve 208. In some embodiments, the second bore 228 of the top sub 202 and the central bore 234 of the packer 204 may be about 2.50+/−0.010, and the outer surface 256 of the sleeve 208 may be about 2.15 inches.

Further, the sleeve 208 may be sized to prevent restriction to the flow of produced hydrocarbon fluids through the gas lift injection packer assembly 200, while also enabling selective movement of downhole tools, such as plunger 124, past or through the gas lift injection packer assembly 200, which increases production and is not readily achievable with traditional gas lift injection systems. In some embodiments, the inner diameter of the inner surface 258 of the sleeve 208 may be about 1.952+/−0.015 inches. Accordingly, it will be appreciated that the upper production tubing 114 and the lower production tubing 120 may comprise the same or substantially similar diameter. In some embodiments, the difference between the inner diameter of the inner surface 258 of the sleeve 208 and the inner diameters of the upper production tubing 114 and the lower production tubing 120 may be not greater than 5.0%, 4.5%, 4.0%, 3.5%, 3.0%, 2.5%, 2.0%, 1.5%, 1.25%, 1.0%, 0.75%, 0.50%, 0.40%, 0.30%, 0.20%, 0.10%, or even 0%. In aspects, the inner diameter of the inner surface 258 of the sleeve 208 and the inner diameters of the upper production tubing 114 and the lower production tubing 120 can be the same or substantially the same. The size of the inner diameter of the inner surface 258 of the sleeve 208 relative to the inner diameter(s) of the production tubing attached gas lift injection packer assembly 200, as disclosed herein, can be referred to as "full drift," or the gas lift injection packer assembly 200 having a "full drift." "Full drift" can additionally refer to a smallest diameter of any bore formed along a longitudinal axis of the top sub 202 being the same as, substantially the same as, or greater than the inner diameter of the production tubing 114, 120. "Full drift" can additionally refer to a smallest diameter of any bore formed along a longitudinal axis of the bottom sub 206 being the same as, substantially the same as, or greater than the inner diameter of the production tubing 114, 120.

Referring to FIGS. 1-5 collectively, the gas lift injection packer assembly 200 may be disposed as a component of the production string 104 between the upper production tubing 114 and the lower production tubing 120. During a gas lift injection operation, the gas lift injection control valve 110 may be operated to control the flow of pressurized gas from the gas lift injection compressor 108, through the gas lift injection control valve 110, and into the upper portion of the annulus 140 of the wellbore 130 formed between the production string 104 and the casing of the wellbore 130. The pressurized gas may enter the gas inlet port 222 and the check valve(s) 220 of the top sub 202 of the gas lift injection packer assembly 200 from the annulus 140. In some embodiments, the check valve(s) 220 may only allow the pressurized gas to enter the gas lift injection packer assembly 200 when the pressure is high enough or surpasses a predetermined threshold.

When the pressure of the pressurized gas is sufficient, the pressurized gas may pass through the check valve(s) 220, through the injected gas runners 224, and enter the manifold 230, where the pressurized gas may enter the micro annulus 226. The pressurized gas may pass through the top sub 202 and the packer 204 via the micro annulus 226 and exit the gas lift injection packer assembly 200 via the gas outlet port 248 formed in the bottom sub 206. This allows the pressurized gas to bypass the packer elements or seals 236. The pressurized gas may flow through the gas outlet port 248 in the bottom sub 206 into the lower portion of the annulus 140 below the packer elements or seals 236, where the pressurized gas may enter one or more gas injection valves 122 disposed in the lower production tubing 120 of the production string 104.

When injected into the lower production tubing 120 via the gas injection valves 122, the pressurized gas may mix with the hydrocarbon fluids in the lower production tubing 120 and/or the wellbore 130, thereby creating a mixture of fluids having a lower density than the density of the hydrocarbon fluids alone. This density reduction caused by the mixture of the pressurized gas with the hydrocarbon fluids effectively reduces a bottomhole pressure (BHP) at a lower end of the production string 104 and/or the wellbore 130, causing the flow of hydrocarbon fluids to increase and/or resume (in the case of a non-productive well) upwards through the production string 104 and to the wellhead 102, where the mixture can be passed through the separator 106 to separate the hydrocarbon fluids from the injected gas.

Further, during the gas injection operation, and as a result of the matching inner diameters of the sleeve 208, the upper production tubing 114, and the lower production tubing 120, downhole tools such as submersible pumps or plunger 124 may be selectively deployed through the gas lift injection packer assembly 200, which is not readily achievable with traditional gas lift injection systems that have a reduced diameter through the packer assembly portion of a traditional production tubing string. Thus, the gas lift injection system 100, when employing the gas lift injection packer assembly 200, enhances hydrocarbon production, which may reduce waste, reduce the number of wells needing to be drilled into a subterranean formation, and further offset expensive operating costs associated with hydrocarbon production.

Figure 6:
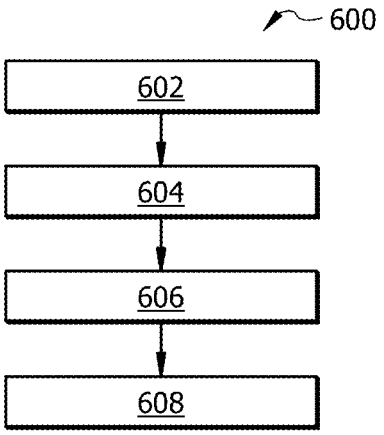
FIG. 6 illustrates a flowchart of a method of gas lift injection according to an embodiment of the disclosure.

FIG. 6 illustrates a flowchart of a method 600 of gas lift injection according to an embodiment of the disclosure. The description of the method 600 may use reference numerals labeled in any of the foregoing figures.

The method 600 may begin at block 602 providing a gas lift injection packer assembly 200 in a production string 104 of a gas lift injection system 100. The gas lift injection packer assembly 200 has any configuration described herein, and these configurations are not reproduced here.

The method 600 may continue at block 604 by injecting a pressurized gas into the wellbore 130. In some embodiments, the pressurized gas may be injected into an upper portion of an annulus 140 of the wellbore 130 formed between the production string 104 and the casing of the wellbore 130 and disposed above the packer elements or seals 236.

The method 600 may continue at block 606 flowing the pressurized gas through the gas lift injection packer assembly 200 to bypass the packer elements or seals 236. In some embodiments, flowing the pressurized gas through the gas lift injection packer assembly 200 may comprise flowing the pressurized gas from the upper portion of the annulus 140 of the wellbore 130 through a one or more check valves (e.g., check valve 220, check valve 221) embedded in the top sub 202, through one or more injected gas runners (e.g., runner 224, runner 233), optionally into the manifold 230 of the top sub 202, into and through the micro annulus 226 formed between the sleeve 208 and each of the top sub 202 and the packer 204, and through a gas outlet port 248 formed in the bottom sub 206 to the lower portion of the annulus 140 of the wellbore 130 below the packer elements or seals 236.

The method 600 may continue at block 608 by flowing the pressurized gas through one or more gas injection valves 122 disposed in the lower production tubing 120 of the production string 104. In some embodiments, flowing the pressurized gas through the gas injection valves 122 may allow the pressurized gas to mix with hydrocarbon fluids in the lower production tubing 120 and/or the wellbore 130, thereby creating a mixture of fluids having a lower density than the density of the hydrocarbon fluids prior to gas injection. In some embodiments, flowing the pressurized gas through the gas injection valves 122 may reduce the bottomhole pressure (BHP) at a lower end of the production string 104 and/or the wellbore 130 and urge a plunger 124 to push the mixture of fluids having the lower density after gas injection upwards through the production string 104 (e.g., the lower production tubing 120, the gas lift injection packer assembly 200, and the upper production tubing 114) and to the wellhead 102. After the fluid is produced from the wellbore 130, the plunger 124 can fall down through the production string 104 (e.g. fall through the upper production tubing 114, the gas lift injection packer assembly 200, and then the lower production tubing 120).

ASPECTS

Aspect 1. A gas lift injection packer assembly comprising: a top sub; a packer coupled to the top sub; a bottom sub coupled to the packer; and a sleeve disposed within the top sub, the packer, and the bottom sub, wherein the sleeve forms a micro annulus in the packer assembly with the top sub and the packer, wherein the sleeve comprises an inner diameter that is the same as, substantially the same as, or not greater than 5% different than an inner diameter of a production tubing coupled to the top sub, to the bottom sub, or to the top sub and to the bottom sub.

Aspect 2. The gas lift injection packer assembly of Aspect 1, wherein a smallest diameter of any bore formed along a longitudinal axis of the top sub is the same as, substantially the same as, or greater than the inner diameter of the production tubing.

Aspect 3. The gas lift injection packer assembly of Aspect 1 or 2, wherein a smallest diameter of any bore formed along a longitudinal axis of the bottom sub is the same as, substantially the same as, or greater than the inner diameter of the production tubing.

Aspect 4. The gas lift injection packer assembly of any one of Aspects 1 to 3, wherein the top sub comprises a central bore configured to receive an end of the sleeve and a second bore that forms the micro annulus with the sleeve; wherein the packer comprises a central bore that forms the micro annulus with an outer surface of the sleeve through the packer; wherein the bottom sub comprises a central bore configured to receive an opposite end of the sleeve, a manifold that fluidly connects the micro annulus to a gas outlet port formed in the bottom sub, and a second bore that fluidly connects an outlet of the bottom sub to an interior of the sleeve.

Aspect 5. The gas lift injection packer assembly of any one of Aspects 1 to 4, wherein the inner diameters of the sleeve, the top sub, the bottom sub, and the production tubing form a continuous passage that enables movement of a downhole tool through the packer assembly.

Aspect 6. The gas lift injection packer assembly of Aspect 5, wherein the downhole tool comprises a submersible pump, a plunger, or a combination thereof.

Aspect 7. The gas lift injection packer assembly of any one of Aspects 1 to 6, wherein the top sub comprises a body having a gas inlet port formed therein, wherein a valve seat of a check valve is disposed in the gas inlet port.

Aspect 8. The gas lift injection packer assembly of Aspect 7, wherein the valve seat of the check valve is threaded into the gas inlet port formed in the body of the top sub.

Aspect 9. The gas lift injection packer assembly of Aspect 7 or 8, wherein the check valve is configured to allow pressurized gas injected into a wellbore to enter the micro annulus.

Aspect 10. The gas lift injection packer assembly of any one of Aspects 7 to 9, wherein an inner wall of the gas inlet port is a housing for the check valve.

Aspect 11. The gas lift injection packer assembly of any one of Aspects 7 to 10, wherein the gas inlet port and the check valve are disposed at an angle of between about 10 degrees and 15 degrees with respect to a central axis of the gas lift injection packer assembly.

Aspect 12. The gas lift injection packer assembly of any one of Aspects 7 to 11, wherein the top sub comprises an injected gas runner fluidly connecting the gas inlet port with the micro annulus.

Aspect 13. A gas lift injection packer assembly comprising: a top sub having a gas inlet port formed therein; a check valve disposed in the gas inlet port, wherein an inner wall of the gas inlet port is a housing for the check valve; a packer coupled to the top sub; a bottom sub coupled to the packer; and a sleeve disposed within the top sub, the packer, and the bottom sub, wherein the sleeve forms a micro annulus with the top sub and the packer, wherein the gas inlet port and the check valve are in fluid communication with the micro annulus.

Aspect 14. The gas lift injection packer assembly of Aspect 13, wherein the sleeve comprises an inner diameter that is the same as, substantially the same as, or not greater than 5% different than an inner diameter of a production tubing coupled to the top sub, to the bottom sub, or to the top sub and to the bottom sub.

Aspect 15. The gas lift injection packer assembly of one of Aspect 13 or claim 14, having any of the features of any one of claims 2 to 12.

Aspect 16. A gas lift injection system comprising: a first production tubing; a gas lift injection packer assembly comprising a top sub, a packer coupled to the top sub, a bottom sub coupled to the packer, and a sleeve disposed within the top sub, the packer, and the bottom sub; and a second production tubing; wherein the top sub is coupled to the first production tubing, wherein the bottom sub is coupled to the second production tubing, and wherein the sleeve comprises an inner diameter that is the same as, substantially the same as, or not greater than 5% different than an inner diameter of the first production tubing, an inner diameter of the second production tubing, or the inner diameter of the first production tubing and the inner diameter of the second production tubing.

Aspect 17. A gas lift injection system comprising: a first production tubing; a gas lift injection packer assembly comprising a top sub having a gas inlet port formed therein; a check valve disposed in the gas inlet port, wherein an inner wall of the gas inlet port is a housing for the check valve; a packer coupled to the top sub; a bottom sub coupled to the packer; and a sleeve disposed within the top sub, the packer, and the bottom sub, wherein the sleeve forms a micro annulus with the top sub and the packer, wherein the gas inlet port and the check valve are in fluid communication with the micro annulus; and a second production tubing; wherein the top sub is coupled to the first production tubing, wherein the bottom sub is coupled to the second production tubing.

Aspect 18. The gas lift injection system of Aspect 16 or 17, further comprising: a gas injection compressor configured to pressurize a gas; a gas lift injection control valve configured to regulate a flow of the pressurized gas from the gas injection compressor into a wellbore; and a wellhead disposed on top of the wellbore; wherein the first production tubing is coupled to the wellhead and extends into the wellbore.

Aspect 19. The gas lift injection system of any one of Aspects 16 to 18, wherein the gas lift injection packer assembly has the features of any one of claims 1 to 15.

Aspect 20. A method of gas lift injection, comprising: providing a production string comprising production tubing and a gas lift injection packer assembly coupled to the production tubing, wherein the gas lift injection packer assembly comprises a top sub, a packer coupled to the top sub, a bottom sub coupled to the packer, and a sleeve disposed within the top sub, the packer, and the bottom sub, wherein the sleeve forms a micro annulus with the top sub and the packer, and wherein the sleeve comprises an inner diameter of not greater than 5% different than an inner diameter of the production tubing; injecting a pressurized gas into an upper portion of an annulus of a wellbore; flowing the pressurized gas from the annulus of the wellbore through the micro annulus; flowing the pressurized gas from the micro annulus through a gas outlet port formed in the bottom sub into a lower portion of the annulus of the wellbore; and flowing the pressurized gas through one or more gas injection valves disposed in a lower portion of the production tubing.

Aspect 21. The method of Aspect 20, further comprising flowing the pressurized gas through one or more check valves embedded in the top sub, through one or more injected gas runners formed in the top sub, through the micro annulus, and out of a one or more gas outlet port formed in the bottom sub.

Aspect 22. The method of Aspect 20 or 21, wherein flowing the pressurized gas through the one or more gas injection valves allows the pressurized gas to mix with hydrocarbon fluids in the lower production tubing to create a fluid mixture having a lower density than a density of the hydrocarbon fluids alone.

Aspect 23. The method of any one of Aspects 20 to 22, wherein flowing the pressurized gas through the one or more gas injection valves reduces a bottomhole pressure (BHP) at the lower production tubing portion to increase the flow of hydrocarbon fluids upwards through the production string and to a wellhead.

Aspect 24. The method of any one of Aspects 20 to 23, having any feature of any one of Aspects 1 to 19.

Aspect 25. The method of any one of Aspects 20 to 24, wherein the inner diameters of the sleeve, the top sub, the bottom sub, and the production tubing form a continuous passage, the method further comprising: moving a downhole tool through the gas lift injection packer assembly via the continuous passage.

Aspect 26. The method of Aspect 25, wherein the downhole tool comprises a submersible pump, a plunger, or a combination thereof.

Although the present disclosure and its advantages have been described in detail, it should be understood that various changes, substitutions, and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A gas lift injection packer assembly comprising:

a top sub;

a packer coupled to the top sub;

a bottom sub coupled to the packer; and a sleeve disposed within the top sub, the packer, and the bottom sub, wherein the sleeve forms a micro annulus in the gas lift injection packer assembly with the top sub and the packer, wherein the sleeve comprises an inner diameter that is same as or not greater than 5% different than an inner diameter of a production tubing coupled to the top sub, to the bottom sub, or to the top sub and to the bottom sub, wherein the inner diameters of the sleeve, the top sub, the bottom sub, and the production tubing form a continuous passage for movement of a downhole tool through the gas lift injection packer assembly, wherein the downhole tool comprises a submersible pump, a plunger or a combination thereof.

2. The gas lift injection packer assembly of claim 1, wherein a smallest diameter of any bore formed along a longitudinal axis of the top sub is the same as or greater than the inner diameter of the production tubing.

3. The gas lift injection packer assembly of claim 1, wherein a smallest diameter of any bore formed along a longitudinal axis of the bottom sub is the same as or greater than the inner diameter of the production tubing.

4. The gas lift injection packer assembly of claim 1, wherein the top sub comprises a central bore configured to receive an end of the sleeve and a second bore that forms the micro annulus with the sleeve; wherein the packer comprises a central bore that forms the micro annulus with an outer surface of the sleeve through the packer; wherein the bottom sub comprises a central bore configured to receive an opposite end of the sleeve, a manifold that fluidly connects the micro annulus to a gas outlet port formed in the bottom sub, and a second bore that fluidly connects an outlet of the bottom sub to an interior of the sleeve.

5. The gas lift injection packer assembly of claim 1, wherein the top sub comprises a body having a gas inlet port formed therein, wherein a valve seat of a check valve is disposed in the gas inlet port.

6. The gas lift injection packer assembly of claim 5, wherein the valve seat of the check valve is threaded into the gas inlet port formed in the body of the top sub.

7. The gas lift injection packer assembly of claim 5, wherein the check valve is configured to allow pressurized gas injected into a wellbore to enter the micro annulus.

8. The gas lift injection packer assembly of claim 5, wherein an inner wall of the gas inlet port is a housing for the check valve.

9. The gas lift injection packer assembly of claim 5, wherein the gas inlet port and the check valve are disposed at an angle of between about 10 degrees and 15 degrees with respect to a central axis of the gas lift injection packer assembly.

10. The gas lift injection packer assembly of claim 5, wherein the top sub comprises an injected gas runner fluidly connecting the gas inlet port with the micro annulus.

11. A gas lift injection system comprising:

a first production tubing;

a gas lift injection packer assembly comprising a top sub, a packer coupled to the top sub, a bottom sub coupled to the packer, and a sleeve disposed within the top sub, the packer, and the bottom sub; and a second production tubing;

wherein the top sub is coupled to the first production tubing, wherein the bottom sub is coupled to the second production tubing, wherein the sleeve comprises an inner diameter that is same as or not greater than 5% different than an inner diameter of the first production tubing, an inner diameter of the second production tubing, or the inner diameter of the first production tubing and the inner diameter of the second production tubing, wherein the inner diameters of the sleeve, the top sub, the bottom sub, the first production tubing, and the second production tubing form a continuous passage for movement of a downhole tool through the gas lift injection packer assembly, wherein the downhole tool comprises a submersible pump, a plunger, or a combination thereof.

12. The gas lift injection system of claim 11, wherein the top sub has a gas inlet port formed therein, wherein the gas lift injection packer assembly further comprises:

a check valve disposed in the gas inlet port, wherein an inner wall of the gas inlet port is a housing for the check valve;

wherein the sleeve forms a micro annulus with the top sub and the packer, wherein the gas inlet port and the check valve are in fluid communication with the micro annulus.

13. The gas lift injection system of claim 11, further comprising:

a gas injection compressor configured to pressurize a gas to form a pressurized gas, a gas lift injection control valve configured to regulate a flow of the pressurized gas from the gas injection compressor into a wellbore; and a wellhead disposed on top of the wellbore;

wherein the first production tubing is coupled to the wellhead and extends into the wellbore.

14. A method of gas lift injection, comprising:

providing a production string comprising production tubing and a gas lift injection packer assembly coupled to the production tubing, wherein the gas lift injection packer assembly comprises a top sub, a packer coupled to the top sub, a bottom sub coupled to the packer, and a sleeve disposed within the top sub, the packer, and the bottom sub, wherein the sleeve forms a micro annulus with the top sub and the packer, and wherein the sleeve comprises an inner diameter of not greater than 5% different than an inner diameter of the production tubing, wherein the inner diameters of the sleeve, the top sub, the bottom sub, and the production tubing form a continuous passage; and moving a downhole tool through the gas lift injection packer assembly via the continuous passage, wherein the downhole tool comprises a submersible pump, a plunger or a combination thereof.

15. The method of claim 14, further comprising:

injecting a pressurized gas into an upper portion of an annulus of a wellbore;

flowing the pressurized gas from the annulus of the wellbore through the micro annulus;

flowing the pressurized gas from the micro annulus through a gas outlet port formed in the bottom sub into a lower portion of the annulus of the wellbore; and flowing the pressurized gas through one or more gas injection valves disposed in a lower portion of the production tubing.

16. The method of claim 15, further comprising flowing the pressurized gas through one or more check valves embedded in the top sub, through one or more injected gas runners formed in the top sub, through the micro annulus, and out of a one or more gas outlet port formed in the bottom sub.

17. The method of claim 15, wherein flowing the pressurized gas through the one or more gas injection valves allows the pressurized gas to mix with hydrocarbon fluids in the production tubing to create a fluid mixture having a lower density than a density of the hydrocarbon fluids alone.

18. The method of claim 15, wherein flowing the pressurized gas through the one or more gas injection valves reduces a bottomhole pressure (BHP) at the lower portion of the production tubing to increase a flow of hydrocarbon fluids upwards through the production string and to a wellhead.

* * * * *